US007770748B2

(12) United States Patent
Elliott

(10) Patent No.: US 7,770,748 B2
(45) Date of Patent: Aug. 10, 2010

(54) TUMBLER WITH CONVERTIBLE LID AND COASTER

(75) Inventor: Andrew T. Elliott, Tempe, AZ (US)

(73) Assignee: Drinique, LLC, Brentwood, TN (US)

( * ) Notice: Subject to any disclaimer, the term of this patent is extended or adjusted under 35 U.S.C. 154(b) by 6 days.

(21) Appl. No.: 12/040,652

(22) Filed: Feb. 29, 2008

(65) Prior Publication Data

US 2009/0218345 A1 Sep. 3, 2009

(51) Int. Cl.
*B65D 41/58* (2006.01)
*B65D 41/56* (2006.01)

(52) U.S. Cl. ..... 220/212; 220/703; 220/737; 215/228; 215/229; 215/388; 215/393

(58) Field of Classification Search ..... 215/205, 215/211, 214, 228, 229, 298, 354, 356, 357, 215/388, 322, 393; 220/212, 253, 254.1, 220/254.9, 322, 705, 707, 709, 744, 811, 220/812, 916, 379, 711; 248/346.11; D7/24.1–625
See application file for complete search history.

(56) References Cited

U.S. PATENT DOCUMENTS

| | | | | | |
|---|---|---|---|---|---|
| 139,170 | A * | 5/1873 | Manning | 215/251 |
| 178,693 | A * | 6/1876 | White | 215/357 |
| 282,974 | A * | 8/1883 | Fairchild | 215/44 |
| 296,876 | A * | 4/1884 | Rosenzi | 215/357 |
| 640,860 | A * | 1/1900 | Baum | 215/377 |
| 684,799 | A * | 10/1901 | Devoe | 215/302 |
| 1,243,033 | A * | 10/1917 | Beatty | 215/326 |
| 1,351,496 | A * | 8/1920 | Spooner | 215/329 |
| 1,457,418 | A * | 6/1923 | Baldwin | 215/357 |
| 1,595,676 | A * | 8/1926 | Merkert | 220/288 |
| 1,634,569 | A * | 7/1927 | Bray | 220/298 |
| 1,778,175 | A * | 10/1930 | Thune | 47/71 |
| 1,957,263 | A * | 5/1934 | Gray | 215/394 |
| 2,041,563 | A * | 5/1936 | Meinecke | 215/227 |
| 2,086,404 | A * | 7/1937 | Daniels | 215/377 |
| 2,257,312 | A * | 9/1941 | Patton | 215/293 |
| 2,689,469 | A * | 9/1954 | Happe et al. | 220/630 |
| 2,766,796 | A * | 10/1956 | Tupper | 220/521 |
| 2,929,526 | A * | 3/1960 | Steinberg | 215/393 |
| 2,955,722 | A * | 10/1960 | Autonious | 215/393 |
| 2,997,199 | A * | 8/1961 | Reachi | 220/23.86 |
| 3,071,281 | A * | 1/1963 | Sawai | 220/4.01 |
| 3,079,037 | A * | 2/1963 | Schechter | 220/212 |
| 3,144,152 | A * | 8/1964 | Kopp | 215/6 |
| 3,217,915 | A * | 11/1965 | Weygandt | 215/10 |
| 3,246,786 | A * | 4/1966 | Holley | 215/393 |
| 3,402,844 | A * | 9/1968 | Chin | 215/393 |
| 3,598,271 | A * | 8/1971 | Holley | 215/227 |
| 3,606,074 | A * | 9/1971 | Hayes | 220/212 |

(Continued)

*Primary Examiner*—Mickey Yu
*Assistant Examiner*—Ned A Walker
(74) *Attorney, Agent, or Firm*—Booth Udall, PLC

(57) ABSTRACT

A tumbler with convertible lid and coaster and methods of use thereof are described. A tumbler comprises a brim, the brim defining an open end of the tumbler, an exterior side wall, an interior side wall comprising a tumbler lug, and a bottom portion comprising a tumbler bottom groove. A convertible lid and coaster comprises a top surface, the top surface further comprises a finger recess, a securable straw hole coupled with the convertible lid and coaster, a side edge comprising a convertible lid and coaster groove, and a bottom surface comprising a recessed opening, the recessed opening comprising a lid and coaster lug.

11 Claims, 3 Drawing Sheets

U.S. PATENT DOCUMENTS 3,721,361 A * 3/1973 Barry et al. ..... 215/330
3,773,243 A * 11/1973 Greene ..... 229/103.1
3,847,494 A * 11/1974 Franklin ..... 403/345
4,040,549 A * 8/1977 Sadler ..... 224/483
4,047,329 A * 9/1977 Holt ..... 47/65.7
4,061,244 A * 12/1977 Tucker ..... 220/212
4,078,686 A * 3/1978 Karesh ..... 215/6
4,127,211 A * 11/1978 Zerbey ..... 220/212
4,163,517 A * 8/1979 Kappler et al. ..... 229/4.5
4,600,111 A * 7/1986 Brown ..... 215/6
4,603,784 A * 8/1986 Chang ..... 215/11.1
4,798,300 A * 1/1989 Ghosh et al. ..... 215/10
4,901,881 A * 2/1990 McElroy ..... 220/287
4,928,848 A * 5/1990 Ballway ..... 220/23.87
5,005,717 A * 4/1991 Oilar ..... 215/13.1
5,040,719 A * 8/1991 Ballway ..... 220/738
5,056,749 A * 10/1991 Ige ..... 248/346.11
5,072,850 A * 12/1991 Gagnon et al. ..... 220/300
5,105,768 A * 4/1992 Johnson ..... 119/61.56
5,123,558 A * 6/1992 Moloney ..... 220/212
5,150,804 A * 9/1992 Blanchet et al. ..... 220/212
5,244,106 A * 9/1993 Takacs ..... 215/373
5,368,186 A * 11/1994 Yeh ..... 220/713
5,409,128 A * 4/1995 Mitchell ..... 220/23.4
D360,338 S * 7/1995 Westgerdes ..... D7/511
5,531,353 A * 7/1996 Ward et al. ..... 220/729
5,570,797 A * 11/1996 Yeh ..... 215/228
5,573,133 A * 11/1996 Park ..... 220/4.27
5,702,020 A * 12/1997 Larsen ..... 220/709
5,711,442 A * 1/1998 Kusz ..... 215/209
D392,845 S * 3/1998 Lown et al. ..... D7/615
5,839,598 A * 11/1998 Mitchell ..... 220/321
5,909,820 A * 6/1999 Yeh ..... 220/711
5,914,116 A * 6/1999 Suares et al. ..... 424/401
6,006,943 A * 12/1999 Laney ..... 220/379
6,131,755 A * 10/2000 Soyka et al. ..... 215/390
6,152,318 A * 11/2000 Walker ..... 220/379
6,164,473 A * 12/2000 Waldrip ..... 215/378
6,179,146 B1 * 1/2001 Betras ..... 220/23.4
6,276,559 B1 * 8/2001 DeMars ..... 220/707
6,289,906 B1 * 9/2001 Dries et al. ..... 134/117
6,398,050 B1 * 6/2002 Allora ..... 215/228
6,409,038 B1 * 6/2002 Karp ..... 220/212
6,719,159 B2 * 4/2004 Chomik ..... 215/343
6,736,285 B2 * 5/2004 Stewart-Stand ..... 220/666
6,752,287 B1 * 6/2004 Lin ..... 220/254.9
D496,222 S * 9/2004 Kleckauskas et al. ..... D7/507
6,863,189 B1 * 3/2005 Teppe ..... 215/322
6,905,038 B2 * 6/2005 Lopez ..... 215/228
7,007,819 B2 * 3/2006 Pollack ..... 220/662
7,021,486 B1 * 4/2006 Hurlbut ..... 220/379
7,066,322 B2 * 6/2006 Wilson ..... 206/217
7,467,726 B1 * 12/2008 Izraelev ..... 215/396
7,591,389 B2 * 9/2009 Wong ..... 220/254.9
2002/0020437 A1 * 2/2002 Dries et al. ..... 134/117
2003/0005617 A1 * 1/2003 Holverson, Jr. ..... 43/41
2004/0056037 A1 * 3/2004 Gluck ..... 220/625
2004/0195197 A1 * 10/2004 Miceli et al. ..... 215/219
2005/0230341 A1 * 10/2005 Dong ..... 215/228
2006/0016820 A1 * 1/2006 Himes et al. ..... 220/740
2006/0081633 A1 * 4/2006 Schmidtner et al. ..... 220/254.9
2008/0035639 A1 * 2/2008 Bast et al. ..... 220/213

* cited by examiner

TUMBLER WITH CONVERTIBLE LID AND COASTER

BACKGROUND

1. Technical Field

Aspects of this document relate generally to vessels for containing beverages.

2. Background Art

The use of beverage vessels in human affairs is well-known. Beverage vessels have been conventionally used for serving and consuming both hot and cold beverages, soups, consommés, and the like. The use of beverage vessels in bars, pubs, taverns, restaurants and other places where beverages are served may present special challenges. In particular, beverage vessels may be subject to accidental or incidental spillage, contamination with foreign objects, or purposeful adulteration. The challenges associated with the use of conventional beverage vessels in bars, pubs, taverns, restaurants and other places where beverages are served may be simply annoying or expensive in the case of inadvertent spillage, or even dangerous in the case of contamination with foreign objects or purposeful adulteration. In addition to the foregoing, beverage vessels in bars, pubs, taverns, restaurants and the like may typically require the use of a beverage coaster or napkin in order to prevent possible condensation or spill damage to tabletops, countertops and the like.

SUMMARY

Aspects of this invention relate to a tumbler with convertible lid and coaster.

In one aspect, a tumbler with convertible lid and coaster device comprises a tumbler comprising a brim, the brim defining an open end of the tumbler, an exterior side wall, an interior side wall comprising a tumbler lug, and a bottom portion comprising a tumbler bottom groove. A convertible lid and coaster comprises a top surface, the top surface further comprising a finger recess, a securable straw hole coupled with the convertible lid and coaster, a side edge comprising a convertible lid and coaster groove, and a bottom surface comprising a recessed opening, the recessed opening comprising a lid and coaster lug.

Particular embodiments of a tumbler with convertible lid and coaster device may include one or more of the following. The tumbler bottom groove and convertible lid and coaster groove may be tapered. The tumbler lug may removably lockingly fit between the tumbler and the convertible lid and coaster when wedged within a narrow portion of the convertible lid and coaster groove. The lid and coaster lug may removably lockingly fit between the tumbler and the convertible lid and coaster when the lid and coaster lug is wedged within a narrow portion of the tumbler groove. The tumbler lug may become un-wedged from within the narrow portion of the convertible lid and coaster groove when the tumbler lug is moved towards a broad portion of the convertible lid and coaster groove. The lid and coaster lug may become un-wedged from within the narrow portion of the tumbler groove when the lid and coaster lug is moved towards a broad portion of the convertible lid and coaster groove. The convertible lid and coaster may be removably coupled within the open end of the tumbler. The convertible lid and coaster may be removably coupled within the open end of the tumbler, the top surface of the convertible lid and coaster is substantially flush with the brim of the tumbler. The convertible lid and coaster may be removably coupled with the bottom portion of a tumbler. The convertible lid and coaster may be removably coupled with the bottom portion of the tumbler, at least a portion of the bottom portion of the tumbler may reside within a recessed opening of the convertible lid and coaster. The securable straw hole may comprise a sliding tab. The securable straw hole may comprise a detenting mechanism.

In another aspect, a method of using a tumbler with convertible lid and coaster device comprises introducing a beverage into a tumbler through an open end of the tumbler, placing a convertible lid and coaster within the open end of the tumbler, aligning a tumbler lug located on an interior side wall of the tumbler with a lid and coaster groove located on an exterior portion of a side edge of a convertible lid and coaster, rotating the convertible lid and coaster relative to the tumbler, wedging the tumbler lug within the lid and coaster groove, and drinking the beverage.

Particular embodiments of method of using a tumbler and convertible lid may comprise the step of introducing a beverage into a tumbler through an open end of the tumbler, where the step comprises first removing a convertible lid and coaster from within an open end of a tumbler. The step of drinking the beverage may comprise maintaining a securable straw hole in an open position and inserting a drinking straw therethrough. The step of drinking the beverage may comprise removing the convertible lid and coaster from within the open end of the tumbler by un-wedging the tumbler lug located on the interior side wall of the tumbler from the lid and coaster groove located on the exterior portion of the side edge of the convertible lid and coaster by rotating the convertible lid and coaster relative to the tumbler. The step of drinking the beverage further may comprise removably coupling the convertible lid and coaster with a bottom portion of a tumbler. The step of removably coupling the convertible lid and coaster with the bottom portion of the tumbler may comprise aligning a lid and coaster lug located on an interior portion of a recessed opening of a convertible lid and coaster with a groove located on an exterior portion of a bottom portion of a tumbler, rotating the convertible lid and coaster relative to the tumbler, and wedging the lid and coaster lug within a tumbler groove located on the exterior portion of the bottom portion of a tumbler.

In another aspect, a method of using a tumbler with convertible lid and coaster device comprises removing a convertible lid and coaster from within an open end of a tumbler and removably coupling the convertible lid and coaster with a bottom portion of the tumbler prior to drinking a beverage. The method further comprises the step of introducing a beverage into a tumbler through an open end of the tumbler. The method further comprises the step of drinking the beverage.

Particular embodiments of method of using a tumbler and convertible lid may comprise removably coupling the convertible lid and coaster within the open end of the tumbler prior to drinking the beverage.

The foregoing and other aspects, features, and advantages will be apparent to those of ordinary skill in the art from the DESCRIPTION and DRAWINGS, and from the CLAIMS.

BRIEF DESCRIPTION OF THE DRAWINGS

Implementations will hereinafter be described in conjunction with the appended DRAWINGS (which are not necessarily to scale), where like designations denote like elements.

DESCRIPTION

This disclosure, its aspects and implementations, are not limited to the specific components or assembly procedures disclosed herein. Many additional components and assembly procedures known in the art consistent with the intended operation of a tumbler with convertible lid and coaster and/or assembly procedures for a tumbler with convertible lid and coaster will become apparent for use with particular implementations from this disclosure. Accordingly, for example, although particular tumblers, brims, exterior side walls, interior side walls, lugs, grooves, convertible lids and coasters, securable straw holes, finger recesses, lugs, grooves and other assemblies, devices and components are disclosed, such may comprise any shape, size, style, type, model, version, class, measurement, concentration, material, weight, quantity, and/or the like consistent with the intended operation of a tumbler with convertible lid and coaster implementation. Implementations are not limited to uses of any specific assemblies, devices and components; provided that the assemblies, devices and components selected are consistent with the intended operation of a tumbler with convertible lid and coaster implementation. In addition, although particular implementations are disclosed, such implementations and implementing components may comprise any shape, size, style, type, model, version, measurement, configuration, material, quantity, and/or the like as is known in the art for such tumbler with convertible lid and coasters and implementing components, consistent with the intended operation thereof.

Structure/Materials

Figure 1:
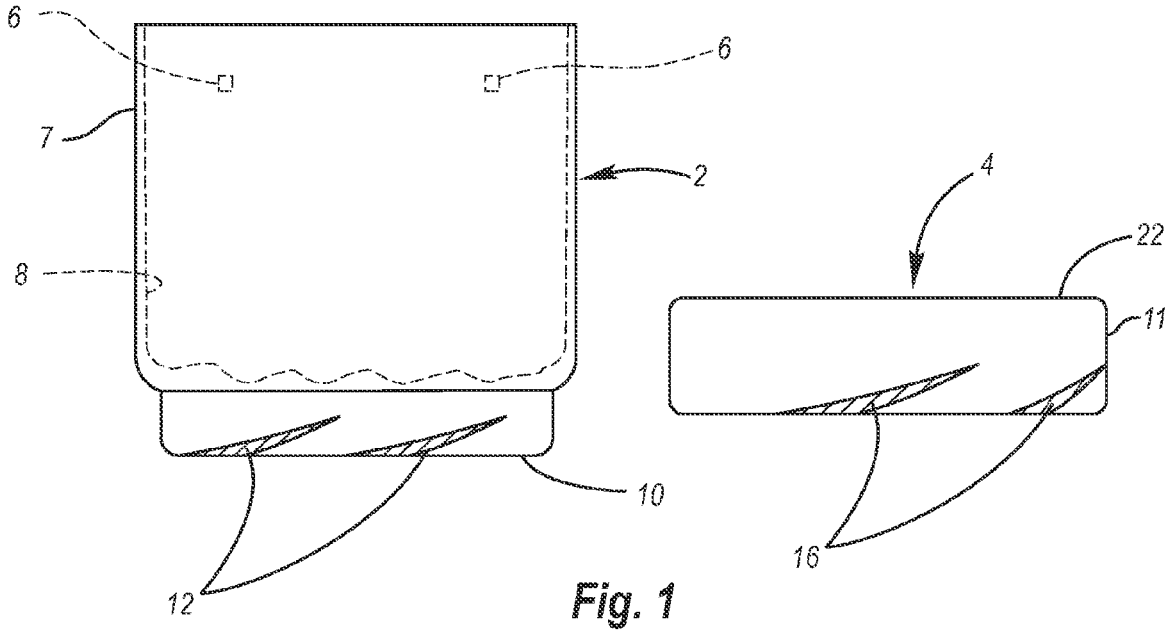
FIG. 1 is a side view of a tumbler with a convertible lid and coaster.

There are a variety of tumbler with convertible lid and coaster implementations. Referring to FIG. 1, a side view of a tumbler and a convertible lid and coaster assembly is illustrated. In some implementations, tumbler 2 may comprise an open end 1 (FIGS. 2 and 3), brim 3, interior side wall 8 and exterior side wall 7. Tumbler 2 may comprise one or more lugs 6 located on interior side wall 8. Lugs 6 may be formed integrally with tumbler 2 or may be formed separately and thereafter coupled with tumbler 2. The one or more lugs 6 may comprise any size or shape that may allow them to removably couple with one or more convertible lid and coaster grooves 16. In some implementations, one or more convertible lid and coaster grooves 16 may be tapered, that is, they may comprise a wide end and a narrow end. In some implementations, one or more lugs 6 may be oriented obliquely with respect to brim 3. In certain implementations, an edge of one or more lugs 6 may be oriented one of at a right angle with and parallel to brim 3. It will be understood that both lug 6 and convertible lid and coaster groove 16 may comprise any shape, size or dimension as long as, together, they provide a removably locking fit when lug 6 is nestled or wedged about a portion of convertible lid and coaster groove 16.

In particular implementations, when the position of lug 6 moves toward a comparatively narrow end of convertible lid and coaster groove 16 (with lug 6 aligned in convertible lid and coaster groove 16), lug 6 may become wedged about the narrow end of convertible lid and coaster groove 16 and may provide a removably locking fit between convertible lid and coaster 4 and tumbler 2. In contrast, when the position of lug 6 moves toward the comparatively wide end of convertible lid and coaster grooves 16 (with lug 6 still aligned in convertible lid and coaster groove 16), lug 6 may become un-wedged from about the narrow end of convertible lid and coaster groove 16 and may thus unlock the removable fit between convertible lid and coaster 4 and tumbler 2. Alternatively, it will be understood that the relative positions of lug 6 and convertible lid and coaster groove 16 may be reversed, so that the grooves are located on interior side wall 8 of tumbler 2 and the lugs are located on side edge 11 of convertible lid and coaster 4. In alternative implementations, lug 6 may comprise a pressure bump, or other protrusion configured to removably wedge or nestle, through a pressure fit, within convertible lid and coaster groove 16.

Still referring to FIG. 1, tumbler 2 may further comprise bottom portion 10 and one or more tumbler bottom grooves 12. Tumbler bottom grooves 12 may be formed integrally with the tumbler during manufacture, or may be formed after the manufacture of the tumbler. In some implementations, one or more tumbler bottom grooves 12 may be tapered, that is, they may comprise a wide end and a narrow end. It will be understood that both lug 23 and tumbler bottom grooves 12 may comprise any shape, size or dimension as long as, together, they provide a removably locking fit when lug 23 is nestled or wedged about a portion of tumbler bottom grooves 12. In particular implementations, when the position of lug 23 moves toward a comparatively narrow end of tumbler bottom grooves 12 (with lug 23 aligned in tumbler bottom grooves 12), lug 23 may become wedged about the narrow end of tumbler bottom grooves 12 and may provide a removably locking fit between convertible lid and coaster 4 and tumbler 2.

Convertible lid and coaster 4 may comprise top surface 22, side edge 11 and one or more convertible lid and coaster grooves 16 in side edge 11. Convertible lid and coaster grooves 16 may be formed integrally in side edge 11 of the convertible lid and coaster 4 contemporaneously during manufacture of convertible lid and coaster 4, or may be formed after the manufacture of convertible lid and coaster 4 by milling, routing, or any other appropriate technique known in the art.

For the exemplary purposes of this disclosure, tumbler 2 and convertible lid and coaster 4 may be formed of: polymers and/or polycarbonates or other like materials; plastics, and/or other like materials; composites and/or other like materials; glass and/or other like materials; ceramics and/or other like materials; porcelain and/or other like materials; metals and/or other like materials; alloys and/or other like materials; and/or any combination of the foregoing. Some components forming a tumbler with convertible lid and coaster may be manufactured simultaneously and integrally joined with one another, while other components may be purchased pre-manufactured or manufactured separately and then assembled with the integral components. Accordingly, manufacture of these components separately or simultaneously may involve vacuum forming, injection molding, blow molding, milling, drilling, reaming, stamping, pressing, cutting and/or the like. Various implementations may be manufactured using conventional procedures as added to and improved upon through the principles described herein.

Figure 2:
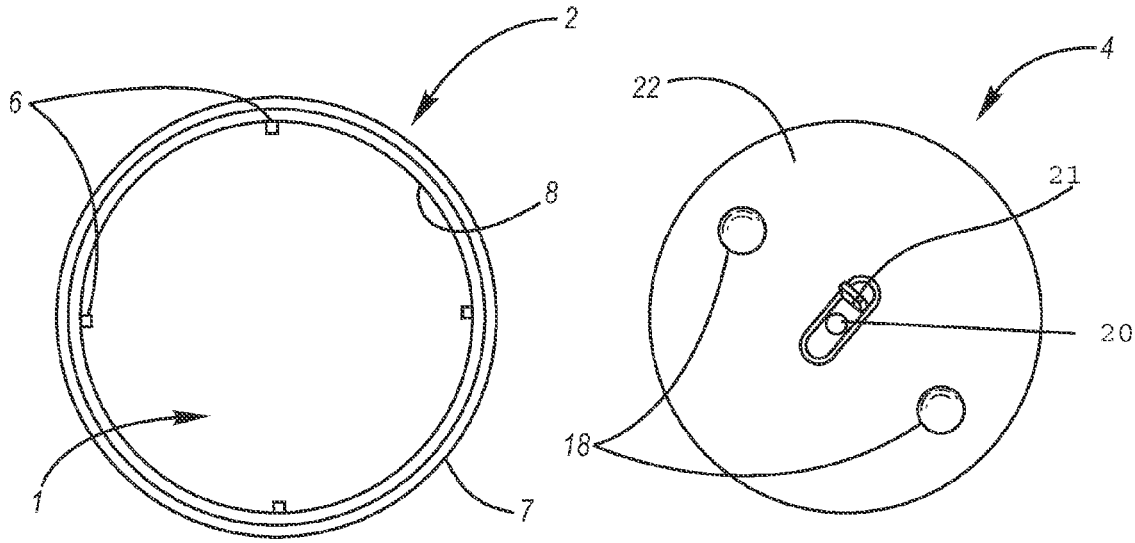
FIG. 2 is a top view of a tumbler with a convertible lid and coaster.

FIG. 2 illustrates a top view of tumbler 2 and convertible lid and coaster 4. Tumbler 2 comprises open portion 1, brim 3, interior side wall 8 comprising one or more lugs 6, and exterior side wall 7. In addition, convertible lid and coaster 4 may comprise top surface 22 and one or more finger recesses 18.

The one or more finger recesses 18 may comprise a depression or other hollow that may allow a user to insert a finger (or other protrusion or extension of a user) therein in order to gain a grasp on convertible lid and coaster 4. It will be understood that the one or more finger recess 18 may not pass all the way through from top surface 22 to a bottom surface of convertible lid and coaster 4 and the one or more finger recesses 18 may comprise any diameter, depth, shape, size, or the like. In addition, one or more finger recesses 18 may be texturized, or provided with other surface characteristics in order to provide a grippier surface upon which a user may grasp. In some implementations, the one or more finger recesses 18 may comprise a projection or other protrusion, instead of a depression, upon which a user may grasp.

Convertible lid and coaster 4 may further comprise a securable straw hole 20. A sliding tab 21, operable to cover the hole 20, may be adjusted in position by a user in order to allow or prevent open communication between top surface 22 and the bottom surface of convertible lid and coaster 4 through the securable straw hole 20. In addition, a detent configured to hold securable straw hole 20 in a temporarily fixed position relative to convertible lid and coaster 4 may be included. It will be understood that a detent may comprise any mechanical arrangement configured to hold a moving part in a temporarily fixed position relative to another part. While a sliding tab 21 with a solid portion to block the hole 20 is illustrated, it will be understood that any device appropriately configured to cover a drinking straw hole 20 may be used without departing from the spirit and scope of this document.

Figure 3:
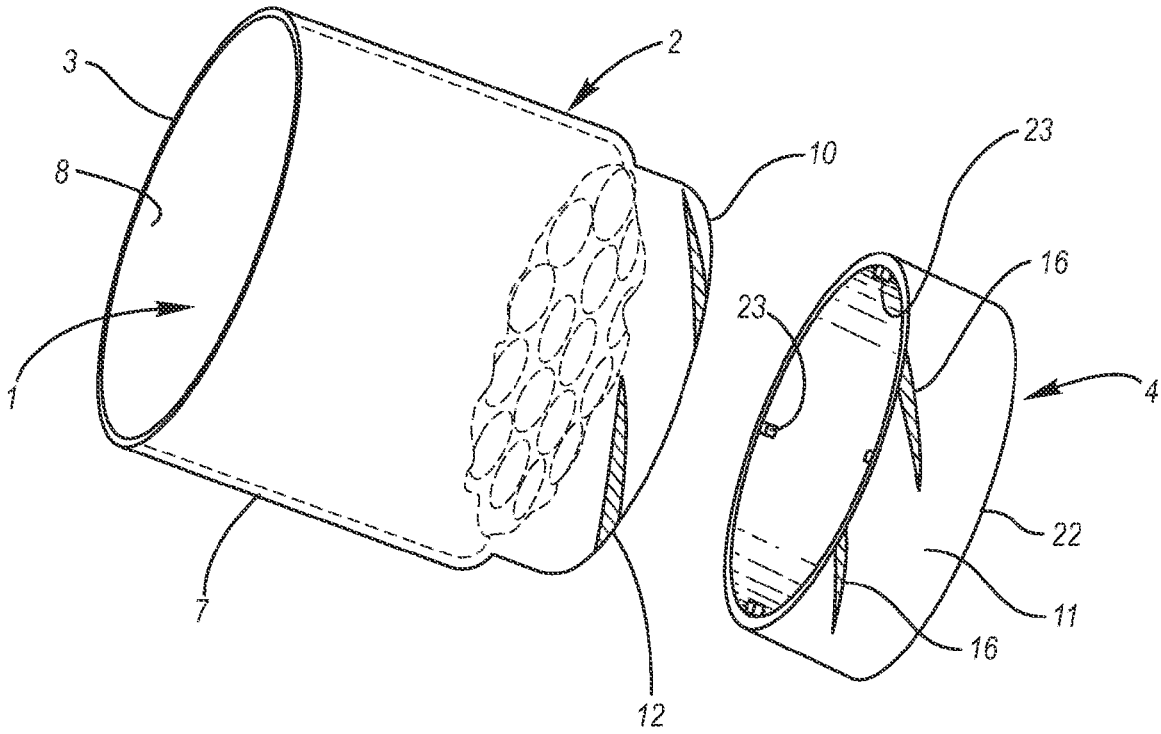
FIG. 3 is a perspective view of a tumbler with a convertible lid and coaster.

FIG. 3 illustrates a perspective view of tumbler 2 with a convertible lid and coaster 4. Convertible lid and coaster 4 may comprise side edge 11, top surface 22 (obscured in this view), and recessed opening 5 within which one or more convertible lid and coaster lugs 23 may be located. It will be understood that the interior diameter of recessed opening 5 may be slightly larger than the exterior diameter of bottom portion 10 of tumbler 2 in order to allow bottom portion 10 to fit within recessed opening 5. Convertible lid and coaster lugs 23 may be formed integrally with the lid or may be formed separately and thereafter coupled thereto. Convertible lid and coaster lugs 23 may be sized to removably couple with one or more tumbler bottom grooves 12. Additionally, convertible lid and coaster 4 may comprise one or more convertible lid and coaster grooves 16 that may be sized to removably couple with one or more lugs 6 on interior side wall 8 of tumbler 2. Tumbler 2 may comprise open end 1, exterior side wall 7, interior side wall 8, and brim 3. Tumbler 2 may further comprise bottom portion 10 further comprising one or more tumbler bottom grooves 12 (with which one or more convertible lid and coaster lugs 23 of lid 4 may removably couple).

Figure 4:
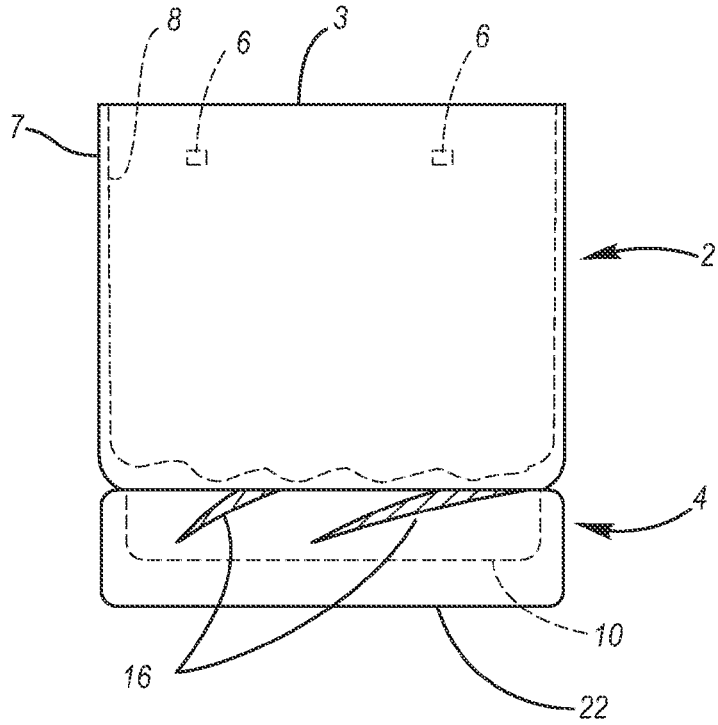
FIG. 4 is a side view of a tumbler coupled with a bottom portion of a convertible lid and coaster.

Referring to FIG. 4, a side view of tumbler 2 removably coupled with convertible lid and coaster 4 is illustrated. One or more convertible lid and coaster lugs 23 are removably coupled with one or more tumbler bottom grooves 12 (obscured in this view by convertible lid and coaster 4) on tumbler 2. The one or more convertible lid and coaster lugs 23 may comprise any size or shape that may allow them to removably couple with one or more tumbler bottom grooves 12. In particular, both convertible lid and coaster lug 23 and tumbler bottom groove 12 may comprise any shape, size or dimension as long as, together, they provide a removably locking fit when convertible lid and coaster lug 23 is nestled or wedged about a narrow portion of tumbler bottom groove 12.

Specifically, when the position of convertible lid and coaster lug 23 moves toward the comparatively narrow end of tumbler bottom groove 12 (with convertible lid and coaster lug 23 aligned in tumbler bottom groove 12), convertible lid and coaster lug 23 may become wedged in the narrow end of tumbler bottom groove 12 and may provide a removably locking fit between convertible lid and coaster 4 and tumbler 2. In contrast, when the position of convertible lid and coaster lug 23 moves toward the comparatively wide end of tumbler bottom groove 12 (with convertible lid and coaster lug 23 aligned in tumbler bottom groove 12), convertible lid and coaster lug 23 may become un-wedged from the narrow end of tumbler bottom groove 12 and may thus unlock the removable fit between convertible lid and coaster 4 and tumbler 2. It will be understood that when convertible lid and coaster 4 is removably coupled with tumbler 2 in the manner illustrated in the non-limiting example provided, that open portion 1 (FIG. 1) may remain open.

Figure 5:
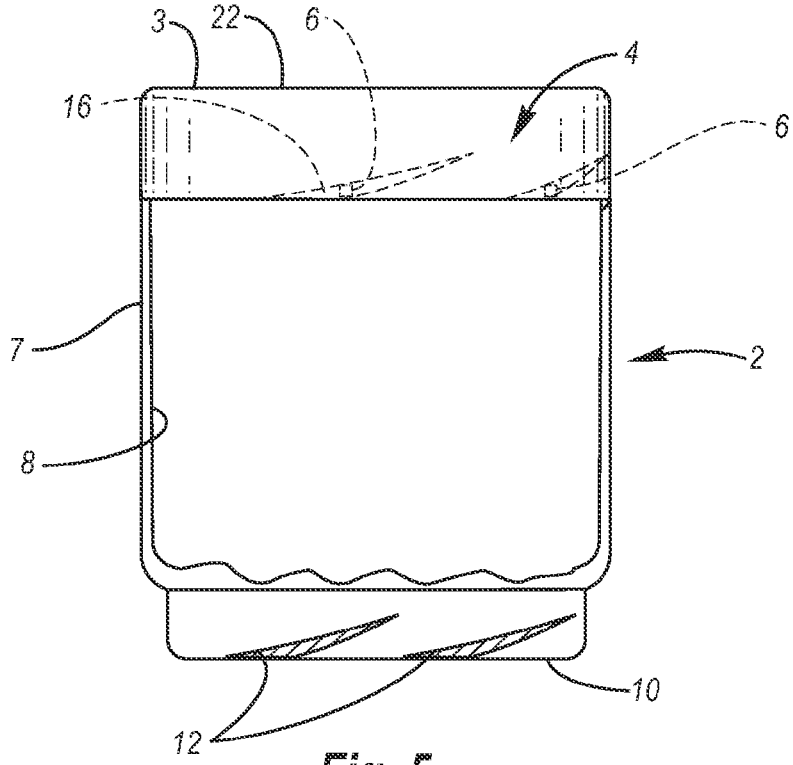
FIG. 5 is a side view of a tumbler coupled within an open end of a convertible lid and coaster.

Referring to FIG. 5, a side view of tumbler 2 removably coupled with convertible lid and coaster 4 is illustrated. Convertible lid and coaster 4 may be situated within open portion 1 (FIGS. 1 and 3) of tumbler 2. One or more lugs 6 located on interior side wall 8 of tumbler 2 may be aligned and engaged with one or more convertible lid and coaster grooves 16 on convertible lid and coaster 4. It will be understood that the interaction of the one or more lugs 6 with one or more convertible lid and coaster grooves 16 may provide a removably locking fit.

Figure 6:
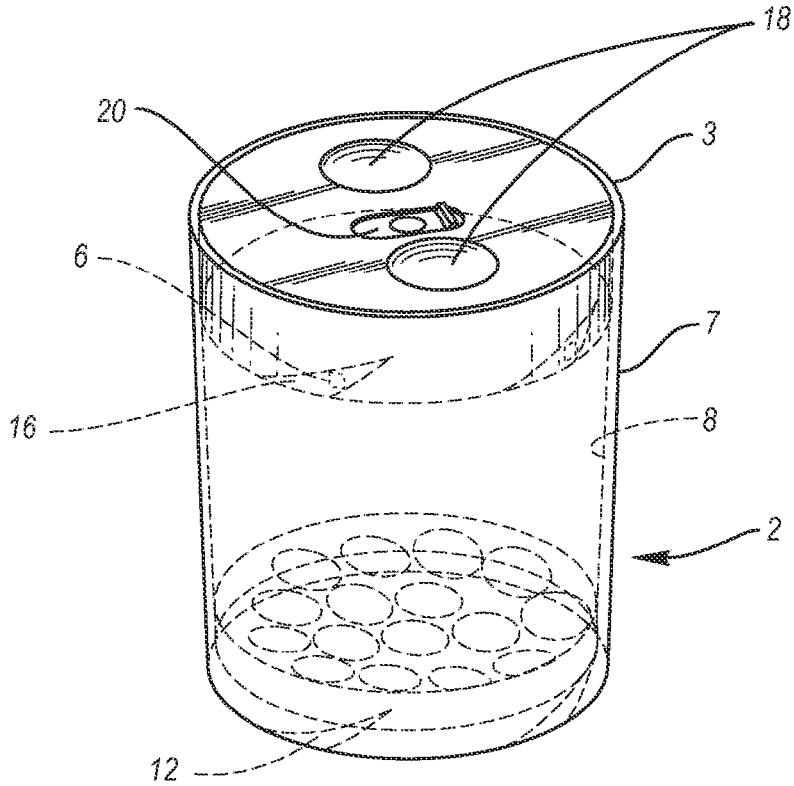
FIG. 6 is a perspective view of a tumbler coupled within an open end of a convertible lid and coaster.

FIG. 6 illustrates a perspective view of tumbler 2 removably coupled with a convertible lid and coaster 4. Convertible lid and coaster 4 may comprise one or more finger recesses 18 that may be grasped by one or more fingers (or other extensions) of a user. Convertible lid and coaster 4 may further comprise securable straw hole 20 that may be opened or closed, maintained in an open or closed position, and may accommodate the insertion of a drinking straw when in an open position. Convertible lid and coaster 4 may further be removably coupled with open end 1 of tumbler 2 such that one or more lugs 6 on interior wall 8 of tumbler 2 may removably interlock with one or more convertible lid and coaster grooves 16. Significantly, when convertible lid and coaster 4 is removably locked within the open end of tumbler 2, top surface 22 of convertible lid and coaster 4 may remain flush with respect to brim of glass 3.

Use

Referring to FIG. 1, the operation of a tumbler with a convertible lid and coaster is illustrated. It will be understood that convertible lid and coaster 4 may be removably coupled within either open end 1 of tumbler 2 or with bottom portion 10 (FIG. 1) of tumbler 2. A user desiring to removably couple convertible lid and coaster 4 within open portion 1 of tumbler 2 may grasp and thereafter insert convertible lid and coaster 4 into the open end of tumbler 2 so that top surface 22 of convertible lid and coaster 4 faces skyward and is oriented substantially parallel to bottom portion 10 of tumbler 2. A user desiring to grasp convertible lid and coaster 4 may do so by inserting their finger into one or more finger recesses 18. Alternatively, a user may grasp any other portion of convertible lid and coaster 4 that may allow a user to manipulate convertible lid and coaster 4 in a desired manner.

Once convertible lid and coaster 4 is inserted by a user within the open end of a tumbler 2 in the foregoing manner, a user may align one or more lugs 6 with one or more convertible lid and coaster grooves 16. Once a user has aligned one or more lugs 6 with one or more convertible lid and coaster grooves 16, a user may thereafter rotate convertible lid and coaster 4 with respect to tumbler 2 in order to removably lock convertible lid and coaster 4 into a fixed position relative to tumbler 2.

In particular, when convertible lid and coaster 4 is rotated (with lug 6 aligned in convertible lid and coaster groove 16) so that the position of lug 6 moves toward the comparatively narrow end of convertible lid and coaster groove 16, lug 6 may become wedged in the narrow end of convertible lid and coaster groove 16 in order to provide a removably locking fit between convertible lid and coaster 4 and tumbler 2. In contrast, when convertible lid and coaster 4 is rotated (with lug 6 aligned in convertible lid and coaster groove 16) so that the position of lug 6 moves toward the comparatively wide end of convertible lid and coaster groove 16, lug 6 may become un-wedged from the narrow end of convertible lid and coaster groove 16 and may thus unlock the removable fit between convertible lid and coaster 4 and tumbler 2. It will be understood that convertible lid and coaster 4 and tumbler 2 may be configured so that a clockwise or a counterclockwise rotation of convertible lid and coaster 4 with respect to tumbler 2 may cause to convertible lid and coaster 4 to removably tighten with respect to tumbler 2.

The operation of tumbler 2 removably coupled with a convertible lid and coaster 4 illustrated in the top view of FIG. 2 will now be described. Once again, convertible lid and coaster 4 may be removably coupled with either open portion 1 of tumbler 2 or bottom portion 10 (FIG. 1) of tumbler 2. A user desiring to removably couple convertible lid and coaster 4 within open portion 1 of tumbler 2 may grasp convertible lid and coaster 4 by one or more finger recesses 18 and thereafter insert convertible lid and coaster 4 into the open end of tumbler 2 so that top surface 22 of convertible lid and coaster 4 faces skyward and is oriented substantially parallel to bottom 10 of tumbler 2. Once a convertible lid and coaster 4 is inserted within the open end of a tumbler 2 in the foregoing manner, a user may align one or more convertible lid and coaster grooves 16 with one or more lugs 6 and thereafter rotate convertible lid and coaster 4 while securely holding tumbler 2, in order to removably lock convertible lid and coaster 4 into a fixed position relative to tumbler 2. Alternatively, a user may rotate tumbler 2 while securely holding convertible lid and coaster 4, in order to removably lock tumbler 2 into a fixed position relative to convertible lid and coaster. It will be understood that when convertible lid and coaster 4 is removably coupled within the open end of tumbler 2, convertible lid and coaster 4 may act as a lid and may further prevent spillage, contamination and/or adulteration of a beverage contained within tumbler 2.

Referring to FIG. 3, the operation of tumbler 2 with convertible lid and coaster 4 is illustrated. A user desiring to removably couple convertible lid and coaster 4 with bottom portion 10 of tumbler 2 may grasp and orient convertible lid and coaster 4 so that recessed opening 5 of convertible lid and coaster 4 faces bottom portion 10 of tumbler 2. Once recessed opening 5 of convertible lid and coaster 4 is oriented facing bottom portion 10 of tumbler 2, a user may thereafter insert a portion of bottom portion 10 into recessed opening 5. A user may further align one or more convertible lid and coaster lugs 23 with one or more tumbler bottom grooves 12. Once the one or more convertible lid and coaster lugs 23 are aligned with one or more tumbler bottom grooves 12 in the foregoing manner, a user may thereafter rotate convertible lid and coaster 4 while securely holding tumbler 2, in order to removably lock convertible lid and coaster 4 into a fixed position relative to tumbler 2 (alternatively, a user may rotate tumbler 2 while securely holding convertible lid and coaster 4, in order to removably lock tumbler 2 into a fixed position relative to convertible lid and coaster).

When convertible lid and coaster 4 is rotated (with convertible lid and coaster lug 23 aligned in tumbler bottom groove 12) so that the position of convertible lid and coaster lug 23 moves toward the comparatively narrow end of tumbler bottom groove 12, convertible lid and coaster lug 23 may become wedged in the narrow end of tumbler bottom groove 12 and may provide a removably locking fit between convertible lid and coaster 4 and tumbler 2. In contrast, when convertible lid and coaster 4 is rotated (with convertible lid and coaster lug 23 aligned in tumbler bottom groove 12) so that the position of convertible lid and coaster lug 23 moves toward the comparatively wide end of tumbler bottom groove 12, convertible lid and coaster lug 23 may become un-wedged from the narrow end of tumbler bottom groove 12 and may thus unlock the removably locking fit between convertible lid and coaster 4 and tumbler 2.

Still referring to FIG. 3, a user desiring to removably couple convertible lid and coaster 4 within open portion 1 of tumbler 2, may grasp convertible lid and coaster 4 by inserting one or more fingers into the one or more finger recesses 18 and thereafter inserting convertible lid and coaster 4 into the open end of tumbler 2 so that top surface 22 of convertible lid and coaster 4 faces skyward and is oriented substantially parallel to bottom 10 of tumbler 2. Once a convertible lid and coaster 4 is inserted within the open end of a tumbler 2 in the foregoing manner, a user may align one or more convertible lid and coaster grooves 16 with one or more lugs 6 and thereafter rotate convertible lid and coaster 4 while securely holding tumbler 2, in order to removably lock convertible lid and coaster 4 into a fixed position relative to tumbler 2. It will be understood that when convertible lid and coaster 4 is removably coupled with bottom portion 10 of tumbler 2, convertible lid and coaster 4 may act as a coaster and may prevent condensation or spill damage to tabletops, countertops and the like. It will be further understood that when convertible lid and coaster 4 is removably coupled with bottom portion 10 of tumbler 2, open portion 1 (FIG. 1) of tumbler 2 may remain open.

Referring to FIGS. 4 and 5, the operation of tumbler 2 with convertible lid and coaster 4 is illustrated. Convertible lid and coaster 4 may be removably coupled either within open portion 1 of tumbler 2 or with bottom portion 10 of tumbler 2. When convertible lid and coaster 4 is removably coupled within open portion 1 of tumbler 2, top surface 22 of convertible lid and coaster 4 may be substantially flush with brim 3 (FIG. 5). Alternatively, convertible lid and coaster 4 may be removably coupled with bottom 10 of tumbler 2, as described above in the use of FIG. 3.

The operation of tumbler 2 removably coupled with convertible lid and coaster 4 illustrated in the top perspective view of FIG. 6 will now be described. A user may introduce a beverage into tumbler 2 (with convertible lid and coaster 4 removed from open portion 1 of tumbler 2). A beverage may include one or more of any of the following: a ready-to-drink beverage; constituent components of a beverage; flavor mixes, syrups or other additives; coloring; fruit; olives; vegetables; ice; seltzer; tonic water; uncarbonated water; carbonated water; a decorative item; soup, broth, consommé, or any other beverage or component thereof.

Once a user has introduced a beverage or beverage component into tumbler 2, a user may thereafter place and removably couple convertible lid and coaster 4 within open end 1 of tumbler 2 in the manner described with regard to FIG. 2, above. Additionally, a user may manipulate into an open position (and thereafter maintain the open position) securable straw hole 20, so that it may accept therethrough a drinking straw or other similar device. Alternatively, a user may manipulate into a closed position securable straw hole 20, so that it may further prevent spillage, contamination or adulteration of a beverage contained within tumbler 2. It will be understood that when securable straw hole 20 is maintained in an open position (with convertible lid and coaster 4 removably coupled within open portion 1 of tumbler 2), top surface 22 of convertible lid and coaster 4 may be in fluid communication with the interior of tumbler 2.

In places where the description above refers to particular implementations of a tumbler with convertible lid and coaster, it should be readily apparent that a number of modifications may be made without departing from the spirit thereof and that these implementations may be applied to other than tumblers with convertible lid and coasters. The accompanying claims are intended to cover such modifications as would fall within the spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A tumbler with convertible lid and coaster device comprising:

a tumbler comprising:

a brim, the brim defining an open end of the tumbler; an exterior side wall comprising a bottom portion opposite the brim, the bottom portion comprising a plurality of internally recessing tumbler grooves; and an interior side wall comprising a plurality of tumbler lugs extending inward therefrom; and a convertible lid and coaster comprising:

a top surface, the top surface further comprising a finger recess; and a securable straw hole through the convertible lid and coaster; a skirt extending down from the top surface to a bottom edge and comprising an external surface comprising a plurality of angled coaster grooves extending upward from the bottom edge, and the skirt comprising an internal surface comprising a plurality of coaster lugs extending inward from the internal surface nearer the bottom edge than the top surface;

wherein the plurality of tumbler lugs engage the plurality of coaster grooves when the convertible lid and coaster is threaded into the open end of the tumbler, and the plurality of coaster lugs engage the plurality of tumbler grooves when the convertible lid and coaster is threaded onto the bottom portion of the tumbler.

2. The device of claim 1, wherein the plurality of tumbler grooves and the plurality of coaster grooves are tapered.

3. The device of claim 1, wherein the top surface of the convertible lid and coaster comprises a sliding tab and the securable straw hole is disposed in the sliding tab.

4. The device of claim 1, wherein the plurality of tumbler lugs removably and lockingly fit between the tumbler and the convertible lid and coaster when each of the plurality of tumbler lugs is wedged within a narrow portion of each of the plurality of coaster grooves.

5. The device of claim 4, wherein the plurality of tumbler lugs become un-wedged from within the narrow portions of the plurality of coaster grooves when each of the plurality of tumbler lugs is moved towards a broad portion of each of the plurality of coaster grooves.

6. The device of claim 1, wherein the plurality of coaster lugs removably and lockingly fit between the tumbler and the convertible lid and coaster when the each of the plurality of coaster lugs is wedged within a narrow portion of each of the plurality of tumbler grooves.

7. The device of claim 6, wherein the plurality of coaster lugs become un-wedged from within the narrow portions of the plurality of tumbler grooves when each of the plurality of coaster lugs is moved towards a broad portion of each of the plurality of coaster grooves.

8. The device of claim 1, wherein the convertible lid and coaster can be removably coupled within the open end of the tumbler.

9. The device of claim 8, wherein when the convertible lid and coaster is removably coupled within the open end of the tumbler, the top surface of the convertible lid and coaster is substantially flush with the brim of the tumbler.

10. The device of claim 1, wherein the convertible lid and coaster can be removably coupled with the bottom portion of a tumbler.

11. The device of claim 10, wherein when the convertible lid and coaster is removably coupled with the bottom portion of the tumbler, at least a portion of the bottom portion of the tumbler resides within a recess of the convertible lid and coaster.

* * * * *